US005771537A

United States Patent [19]

Ho

[11] Patent Number: 5,771,537

[45] Date of Patent: Jun. 30, 1998

[54] HANDLE DEVICE ADAPTED TO BE ATTACHED TO TWO MOUNTING HOLES

[76] Inventor: Chin-Lien Ho, No. 36, Lo-Yang Rd.,, Hsi-Tun Dist., Taichung, Taiwan

[21] Appl. No.: 823,705

[22] Filed: Mar. 25, 1997

[51] Int. Cl.[6] ..... A47B 95/02

[52] U.S. Cl. ..... 16/125; 16/126; 16/112; 190/115

[58] Field of Search ..... 16/125, 126, 127, 16/119, 112, 116 A; 190/115, 116, 117, 39

[56] References Cited

U.S. PATENT DOCUMENTS

| | | | |
|---|---|---|---|
| 3,289,798 | 12/1966 | Gehrie | 190/115 |
| 3,707,016 | 12/1972 | Smoot | 16/125 |
| 4,261,078 | 4/1981 | Edwards et al. | 16/126 |
| 4,280,247 | 7/1981 | Burzen et al. | 16/112 |
| 4,357,734 | 11/1982 | Moore | 16/125 |
| 4,364,150 | 12/1982 | Remington | 16/126 |

*Primary Examiner*—Chuck Mah
*Attorney, Agent, or Firm*—Panitch Schwarze Jacobs & Nadel, P.C.

[57] ABSTRACT

A handle device is adapted to be attached on an article having an upper wall with two spaced mounting holes. The handle device includes an elongated mounting plate, an elongated carrier strap, two resilient slide members and a blocking member. The mounting plate is adapted be disposed underneath the upper wall of the article, and has two spaced positioning seats adapted to be exposed outwardly of the mounting holes of the upper wall. Each of the positioning seats has a retaining stud. The carrier strap has two opposed end portions and two openings formed through the end portions and sleeved around the retaining studs in such a manner that the carrier strap is suspended by the retaining studs so as to define a clearance with the upper wall of the article for gripping the carrier strap. Each of the slide members can be snugly fitted on a corresponding one of the positioning seats when the slide member is slid from an outboard position to an inboard position relative to the positioning seat. The blocking member is disposed on each of the slide members and can be brought to cover the retaining stud when the slide member is slid to snugly fit on the positioning seat to prevent the carrier strap from slipping off from the positioning seat.

4 Claims, 6 Drawing Sheets

HANDLE DEVICE ADAPTED TO BE ATTACHED TO TWO MOUNTING HOLES

BACKGROUND OF THE INVENTION

1. Field of the Invention

The invention relates to a handle device, more particularly to a handle device which is adapted to be mounted easily on an article having an upper wall formed with two spaced mounting holes.

2. Description of the Related Art

Handle devices are known in the art and are used for carrying articles. The prior art handle devices are generally riveted on the articles by means of a punching machine. Thus, the riveting operation involves extra expense to the manufacturer.

SUMMARY OF THE INVENTION

The object of this invention is to provide a handle device which is adapted to be attached easily on an article having an upper wall formed with two spaced mounting holes to obviate the use of rivets.

The handle device of this invention is adapted to be attached on an article having an upper wall with two spaced mounting holes. The handle device includes an elongated mounting plate, an elongated carrier strap, two resilient slide members, and a blocking member. The mounting plate is adapted be disposed underneath the upper wall of the article and has two spaced positioning seats adapted to be exposed outwardly of the mounting holes of the upper wall. Each of the positioning seats has an upright retaining stud. The carrier strap has two opposed end portions and two openings formed through the end portions. The end portions of the carrier strap are respectively sleeved around the retaining studs in such a manner that the carrier strap is suspended by the retaining studs so as to define a clearance with the upper wall of the article for gripping the carrier strap. The slide members are respectively slidable relative to the positioning seats in a longitudinal direction of the mounting plate. Each of the slide members can be snugly fitted on a corresponding one of the positioning seats when the slide member is slid from an outboard position to an inboard position relative to the positioning seat.

The blocking member is disposed on each of the slide members and can be brought to be over the retaining stud when the slide member is slid to snugly fit on the positioning seat to prevent the carrier strap from slipping off from the positioning seat.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

A handle device of this invention is adapted to be attached on an article, such as a briefcase or a trunkcase, having an upper wall formed with two spaced mounting holes. Thus, the article can be carried along by the use of the handle device.

Figure 1:
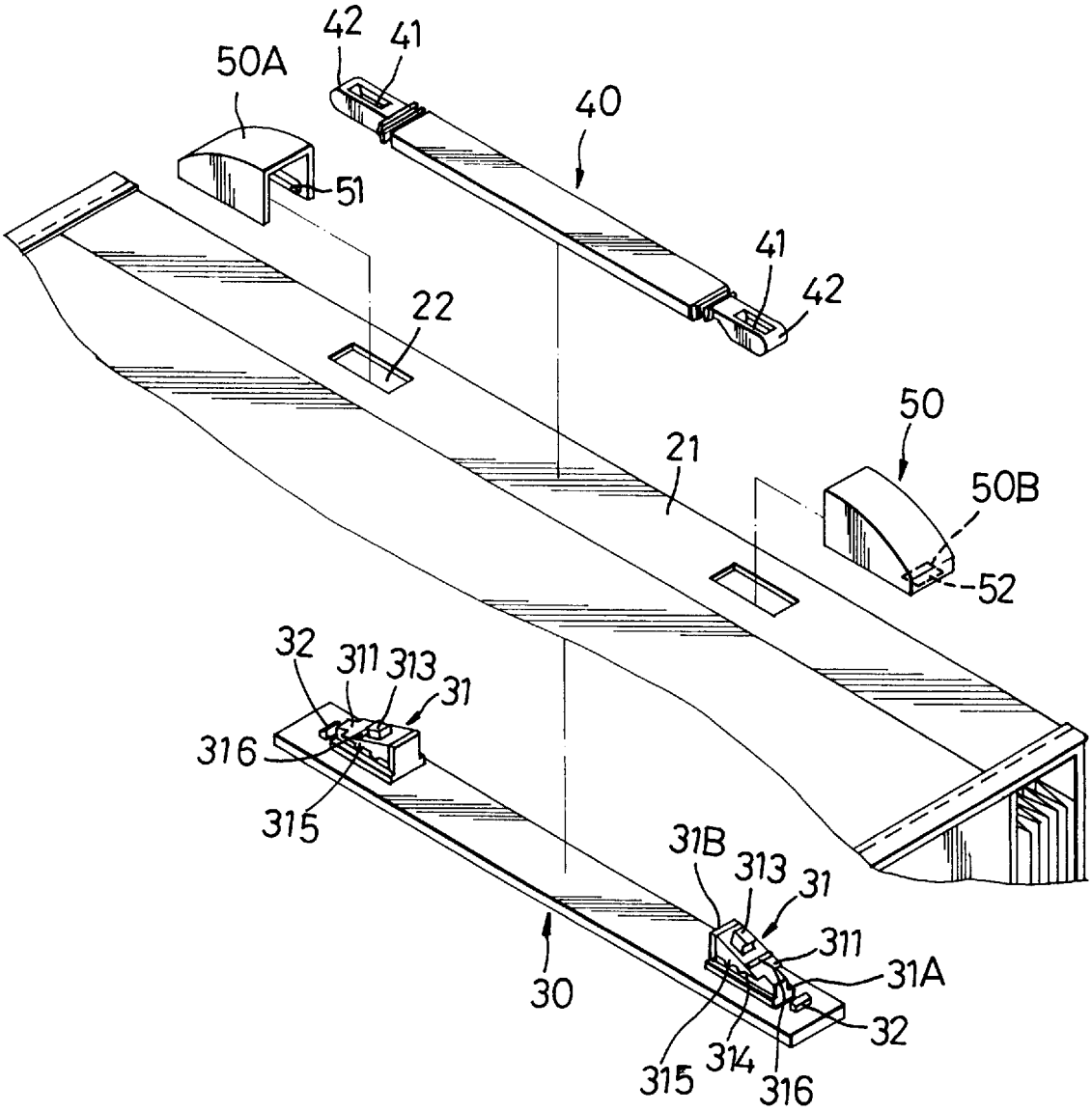
FIG. 1 is an exploded view of a handle device of this invention shown together with an upper wall of a briefcase upon which the handle device is to be mounted.
Figure 2:
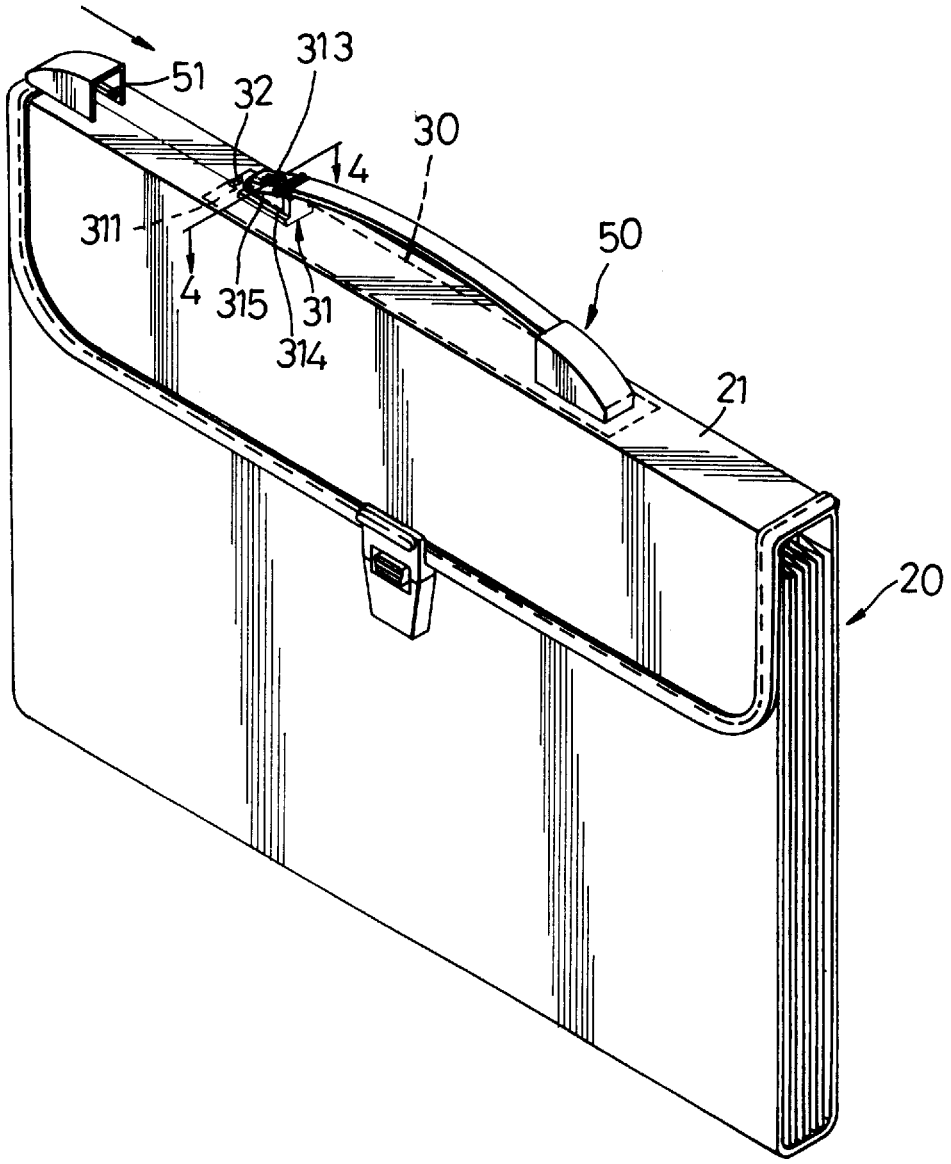
FIG. 2 illustrates how the handle device of this invention is mounted on the upper wall of the briefcase.
Figure 3:
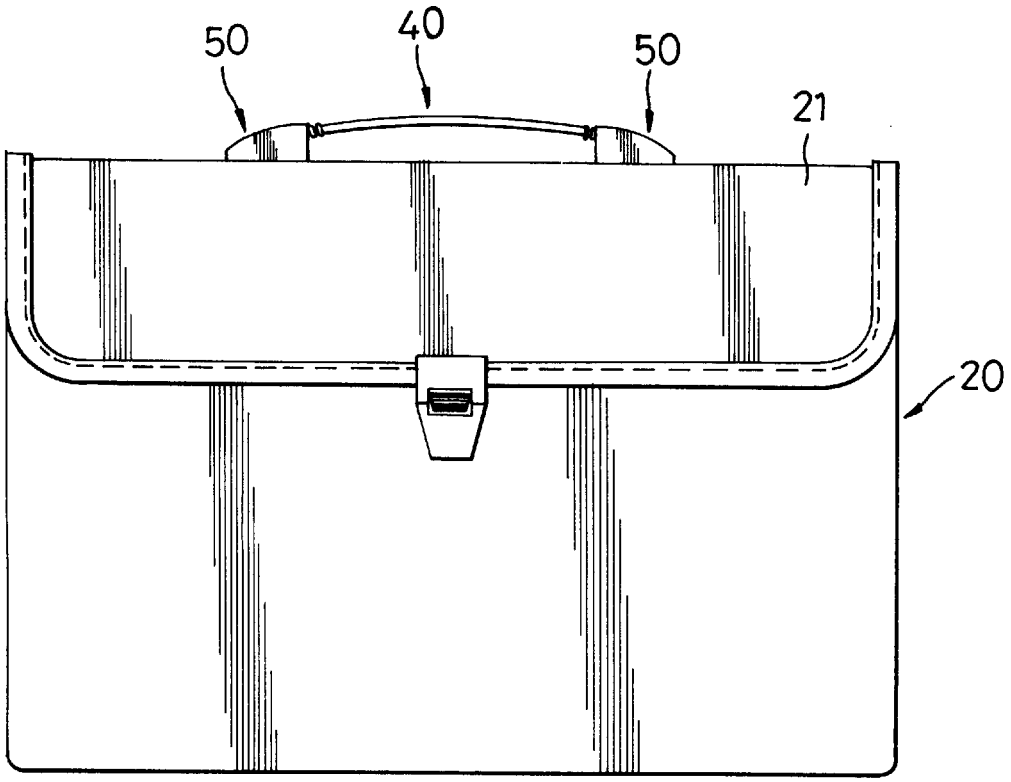
FIG. 3 shows a briefcase provided with the handle device of this invention.

As illustrated in FIGS. 1, 2 and 3, the handle device includes an elongated mounting plate 30, an elongated carrier strap 40, and two shell-like resilient slide members 50. The mounting plate 30 is disposed underneath the upper wall 21 of the briefcase 20 in such a manner that two positioning seats 31 of the mounting plate 30 are exposed outwardly of the mounting holes 22. Each of the positioning seats 31 has an outer end portion 31A proximate to an end of the mounting plate 30, an inner end portion 31B, an inclined face 311 which gradually declines from the inner end portion 31B toward the outer end portion 31A, and a retaining stud 313 formed on the inclined face 313. The mounting plate 30 further has two stop elements 32 formed thereon respectively adjacent to the outer end portions 31A of the positioning seats 31.

The carrier strap 40 has two opposed end portions 42 and two openings 41 formed through the end portions 42 respectively. The openings 41 of the carrier strap 40 are sleeved respectively around the retaining studs 313 of the positioning seats 31 in such a manner that the carrier strap 40 is suspended by the retaining studs 313 so as to define a clearance with the upper wall 21 of the briefcase 20 for gripping the carrier strap 40.

Figure 4:
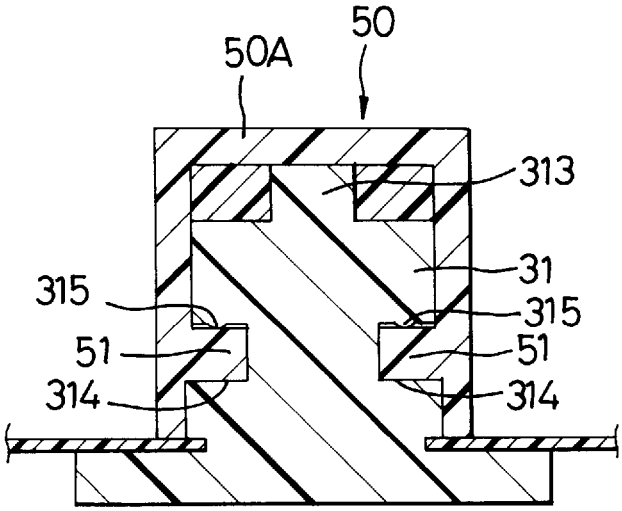
FIG. 4 is a cross sectional view of the handle device of this invention taken along line 4—4 in FIG. 2.

Each of the slide members 50 has a block member 50A covering an upper portion thereof, an elongated engagement tongue 51 which is formed on a lateral side thereof and which extends in the longitudinal direction of the mounting plate 30, and a bottom wall 50B formed with a stop hole 52. The slide members 50 are slid along the longitudinal direction of the mounting plate 30 from an outboard position to an inboard position relative to the positioning seat 31 until the stop elements 32 of the mounting plate 30 extend into the stop holes 52 of the slide members 50. Thus, the slide members 50 cannot further slide inboard relative to the positioning seats 31 so as to snugly fit the slide members 50 on the positioning seats 31 such that the engagement tongues 51 of the slide members 50 engage the engagement grooves 314 of the positioning seat 31. Under this condition, as illustrated in FIG. 4, the block member 50A of the slide member 50 covers the retaining stud 313 of the positioning seat 31 so as to prevent the carrier strap 40 from slipping off from the positioning seat 31. Note that the engagement grooves 314 of the positioning seats 31 can be provided with bosses 315 in order to increase the engagement strength of the tongues 51 in the grooves 314.

Figure 5:
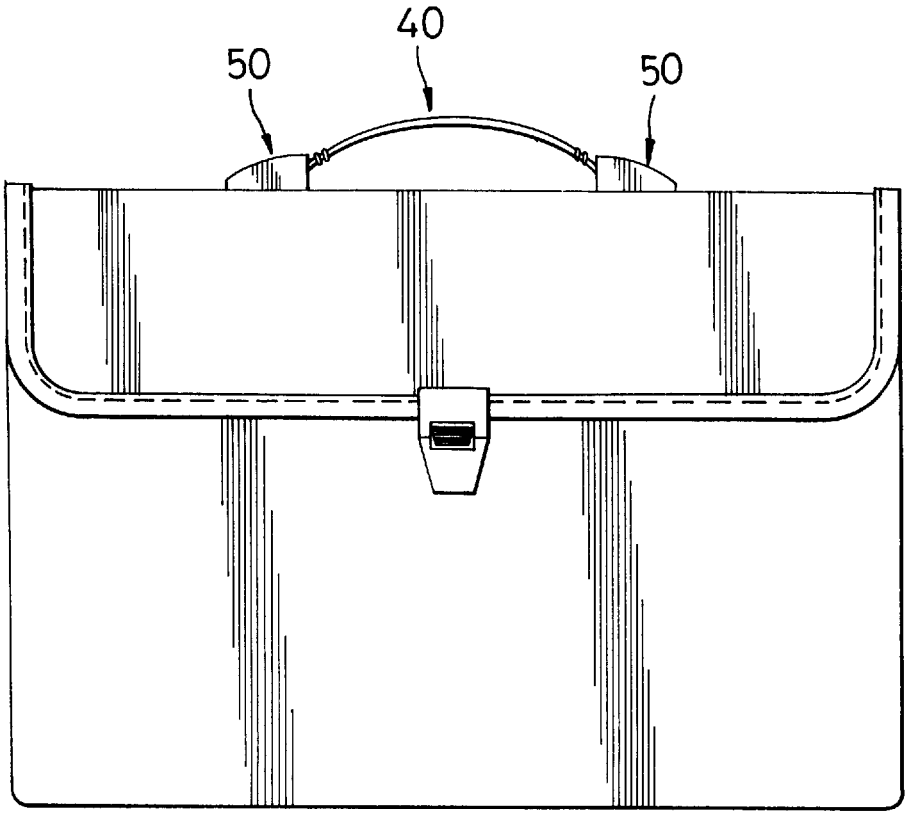
FIG. 5 shows the briefcase provided with the handle device of this invention, wherein a carrier strap of the handle device is illustrated in a curved condition.
Figure 6:
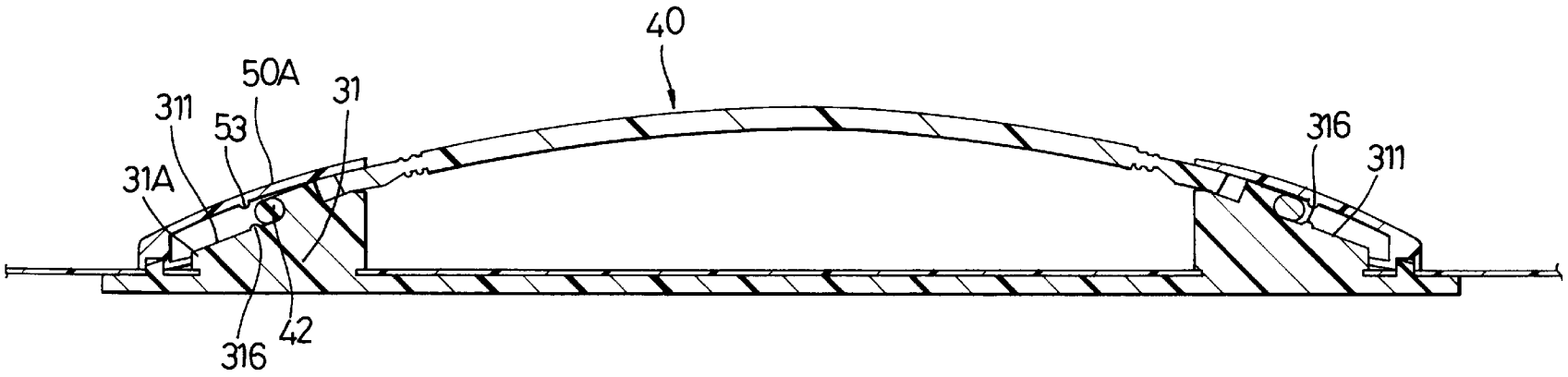
FIG. 6 is a sectional view of the handle device shown in FIG. 5.

Referring to FIGS. 5 and 6, in order to extend the carrier strap 40 in the curved condition, the inner surface of the block member 50A and the inclined face 311 of the positioning seat 31 are respectively provided with stop projections 53, 316 which extend transversely to the longitudinal direction of the mounting plate and which stop the ends 42 of the carrier strap 40 from moving toward the outer end portions 31A of the positioning seats 31. This facilitates gripping of the carrier strap 40.

With this invention thus explained, it is apparent that numerous modifications and variations can be made without departing from the scope and spirit of this invention. It is therefore intended that this invention be limited only as indicated in the appended claims.

I claim:

1. A handle device adapted to be attached easily on an article having an upper wall formed with two spaced mounting holes such that said article can be carried along by use of said handle device, said handle device comprising:

an elongated mounting plate adapted be disposed underneath said upper wall and including two spaced positioning seats adapted to be exposed outwardly of said mounting holes, each of said positioning seats having an upright retaining stud;

an elongated carrier strap having two opposed end portions and two openings formed through said end portions, said end portions respectively being sleeved around said retaining studs of said positioning seats in such a manner that said carrier strap is suspended by said retaining studs so as to define a clearance with said upper wall of said article for gripping said carrier strap;

two resilient slide members respectively slidable relative to said positioning seats in a longitudinal direction of said mounting plate, each of said slide members being capable of being snugly fitted on a corresponding one of said positioning seats when said slide member is slid from an outboard position to an inboard position relative to said positioning seat; and a blocking member disposed on each of said slide members and brought to be over said retaining stud when said slide member is slid to snugly fit on said positioning seat so as to prevent said carrier from slipping off from said positioning seat.

2. The handle device as defined in claim 1, wherein each of said positioning seats has an outer end portion proximate to an end of said mounting plate, an inner end portion, an inclined face which gradually declines from said inner end portion toward said outer end portion, said retaining stud being formed on said inclined face and consequently tending said carrier strap in a curved condition.

3. The handle device as defined in claim 1, wherein each of said positioning seats has an engagement groove which extends in the longitudinal direction of said mounting plate, each of said slide members having an engagement tongue which engages slidably said engagement groove of said positioning seat.

4. The handle device as defined in claim 3, wherein each of said slide members is formed as a hollow shell and has said block member covering an upper portion thereof and a bottom wall formed with a stop hole, said mounting plate further including two stop elements formed thereon respectively adjacent to said outer end portions of said positioning seats and extending into said stop holes of said slide members so that said slide member cannot further slide inboard relative to said positioning seat, thereby preventing disengagement of said slide member from said positioning seat.

* * * * *